US010341750B2

(12) United States Patent
McGarry et al.

(10) Patent No.: US 10,341,750 B2
(45) Date of Patent: Jul. 2, 2019

(54) PRESSURE EQUALIZATION AUDIO SPEAKER DESIGN

(71) Applicant: Logitech Europe S.A., Lausanne (CH)

(72) Inventors: Stephen McGarry, Vancouver, WA (US); Steven Warren Pooler, Vancouver, WA (US); Jeffrey Anderson, Camas, WA (US)

(73) Assignee: LOGITECH EUROPE S.A., Lausanne (CH)

( * ) Notice: Subject to any disclaimer, the term of this patent is extended or adjusted under 35 U.S.C. 154(b) by 38 days.

(21) Appl. No.: 15/163,639

(22) Filed: May 24, 2016

(65) Prior Publication Data

US 2016/0366499 A1 Dec. 15, 2016

Related U.S. Application Data

(60) Provisional application No. 62/175,884, filed on Jun. 15, 2015.

(51) Int. Cl.
*H04R 25/00* (2006.01)
*H04R 1/02* (2006.01)
(Continued)

(52) U.S. Cl.
CPC ..... *H04R 1/023* (2013.01); *H04R 7/125* (2013.01); *H04R 31/003* (2013.01);
(Continued)

(58) Field of Classification Search
CPC ..... H04R 1/42; H04R 1/02; H04R 1/2803; H04R 1/2811; H04R 1/2834; H04R 2499/11; H04R 1/2842; H04R 1/288
(Continued)

(56) References Cited

U.S. PATENT DOCUMENTS 4,224,469 A * 9/1980 Karson ..... H04R 1/26 181/144
6,275,597 B1 * 8/2001 Roozen ..... H04R 1/2826 181/156

(Continued)

OTHER PUBLICATIONS

Porex IP-Rated Protection Vents. www.Porex.com. Corporation. 2014.

(Continued)

*Primary Examiner* — Phylesha Dabney
(74) *Attorney, Agent, or Firm* — Patterson & Sheridan, LLP

(57) ABSTRACT

The present disclosure generally provides an apparatus and method of forming a pressure equalizing audio speaker that can be easily manufactured and provides a high quality audio output. One or more of the embodiments of the disclosure provided herein include a sealed enclosure that has at least one liquid impermeable and gas permeable region that allows the flow of a gas between an interior region and an exterior region, while preventing or substantially inhibiting the movement of a liquid from the exterior region into the internal region. In general, the liquid impermeable and gas permeable regions are configured to allow slowly changing gas pressures registered between the internal region and exterior region to be relieved, while allowing rapidly changing gas pressures generated by the diaphragm at audible frequencies to function at a desired level during use.

20 Claims, 11 Drawing Sheets

(51) Int. Cl.
*H04R 7/12* (2006.01)
*H04R 31/00* (2006.01)

(52) U.S. Cl.
CPC .. *H04R 2201/029* (2013.01); *H04R 2307/025* (2013.01); *H04R 2499/11* (2013.01)

(58) Field of Classification Search
USPC ..... 381/161, 345, 348, 353, 351, 386; 181/148, 149
See application file for complete search history.

(56) References Cited

U.S. PATENT DOCUMENTS 7,925,035 B2 * 4/2011 Stenmark ..... H04M 1/035 381/337
8,767,994 B2 7/2014 Tam
8,885,863 B2 * 11/2014 Takashima ..... B82Y 30/00 181/148
2004/0231911 A1 * 11/2004 Welker ..... H04R 1/26 181/165
2006/0018499 A1 * 1/2006 Guyot ..... H04R 1/2811 381/347
2007/0165895 A1 * 7/2007 Matsumura ..... H04R 1/2803 381/351
2010/0135516 A1 * 6/2010 Saiki ..... H04R 1/2811 381/386
2015/0256922 A1 * 9/2015 Shi ..... H04R 1/2842 381/353
2015/0271594 A1 * 9/2015 Beer ..... H04R 1/2803 381/345
2016/0037243 A1 * 2/2016 Lippert ..... H04R 1/023 381/166
2017/0078775 A1 * 3/2017 McGarry ..... H04R 1/02

OTHER PUBLICATIONS

Woofer. (Aug. 12, 2015). In Wikipedia, The Free Encyclopedia. Retrieved 16:41, Aug. 18, 2015, from <https://en.wikipedia.org/w/index.php?title=Woofer&oldid=675706503>.

* cited by examiner

PRESSURE EQUALIZATION AUDIO SPEAKER DESIGN

CROSS REFERENCE TO RELATED APPLICATIONS

This application claims benefit of U.S. provisional patent application Ser. No. 62/175,884, filed Jun. 15, 2015, which is hereby incorporated herein by reference.

BACKGROUND

Field

Embodiments of the present disclosure generally relate to an audio device and, more specifically, to an apparatus and method of forming a sealed audio speaker assembly.

BACKGROUND

Description of the Related Art

An important feature in a desirable audio speaker design is sound quality. With the advent of mobile media players, such as smart phones, iPods®, and other devices, there has been an effort to develop small audio speakers, and in particular wireless speakers that receive a stream of digital information that is translated into sound via one or more speakers.

Typically, audio speakers include an enclosure and at least one sound transducer, or active driver speaker, having a diaphragm that produces sound waves by converting an electrical signal into mechanical motion of the driver diaphragm. Sound transducers, such as active driver speakers, typically generate sound waves by physically moving air at various frequencies. That is, an active driver speaker pushes and pulls a diaphragm in order to create periodic increases and decreases in air pressure, thus creating sound.

To create an audio speaker that has good sound quality and meets the use requirements of active portable lifestyles of today, it is desirable to form a speaker enclosure that is sealed to prevent ingress of dirt and water while the speaker is being used outdoors and exposed to accidents where the speaker may become submerged in water or drenched from water activity or rain. Traditional speaker designs may use port tubes which have no resistance to ingress.

FIG. 1 illustrates a conventional sealed active speaker assembly 100. The sealed active speaker assembly 100 includes a sealed enclosure 110 that includes a speaker 150 and a conventional amplifier assembly 90 that is typically positioned in an external region 102 that is outside the enclosure 110. The sealed enclosure 110 generally includes one or more walls 111 that enclose an internal region 101. The speaker 150 generally includes a diaphragm 152, a support frame 154, a surround 156, a voice coil 155, a pole piece 158, a permanent magnet 157, a dust cover 153 and a spider 159. During operation, the amplifier assembly 90 delivers a signal to the speaker 150, which causes the voice coil 155 to move the diaphragm 152 relative to the enclosure 110 (e.g., +/−Z-direction) due to the varying magnetic field generated by the coil 155 reacting to the fixed magnetic field generated by the permanent magnet 157. Typically, the diaphragm 152 has a desired movement range, which is related to a configuration of the frame 154, and has a mid-operation point. To minimize distortion, it is desired that the diaphragm 152 move outward and inward linearly with the bi-polar voltage applied by the amplifier 90. When in operation, the driven diaphragm 152 creates a pumping action as it moves in the plus and minus Z-directions, which affects the pressure in the internal region 101. The pressure variation in the internal region 101 can be very rapid as the speaker 150 generally delivers audible sounds at frequencies greater than 20 hertz (Hz), and the generated transient pressures in the internal region 101 can be as high as 100 psig.

It is common for conventional speaker manufacturers to strive to form a "sealed" speaker design. While it may be possible to manufacture a truly sealed speaker assembly that will not allow liquids or gases to pass in and out of the enclosure, this type of device can be very costly to manufacture. Most manufacturable consumer electronic designs today are not air tight, or even truly liquid tight. Moreover, trying to produce a fully sealed speaker design that has a desirable device yield during manufacturing and/or a desirable production cost is problematic. A conventional sealed speaker that is not completely liquid-tight or gas-tight will typically have short term and long term sound quality issues and may not be able to reliably meet typical water tight specifications required by consumer electronics manufacturers today. One common problem with conventional sealed enclosures relates to the monotonic increase or decrease in the pressure level within the enclosure due to the leak in the enclosure having a preferred leak direction "A" (FIG. 1). The creation of a leak that has a preferred leak direction is often created by the design of the seals 91 in the speaker enclosure. In some cases, the preferred leak direction acts as a one-way-valve that allows fluid movement in only one direction due to the design of seals used in the speaker assembly. The one way movement of fluid into or out of the internal region of the enclosure can, for example, cause a build up in positive or negative pressure that will alter the position of the active components in the speaker(s), such as the speaker diaphragm, and alter the range of motion of the diaphragm during operation.

As small and portable consumer electronic devices become more popular the need for a small liquid proof device that has good sound quality, has a low production cost and is manufacturable has increased in recent years. However, in the small speaker designs the volume of the internal region 101 is small compared to the amount of movement of the diaphragm 152 during normal operation. Thus, the pumping action of the diaphragm 152 during normal use in a small speaker can rapidly generate a large built-up internal pressure in the internal region 101 due to a leak in a conventional sealed speaker assembly. The built-up pressure in the internal region will cause the diaphragm's un-driven position to move from the desired mid-point of the diaphragm movement range and the mid-point of the coil driven region, which will limit the movement of the diaphragm, create distortion in the reproduction of the audio signal and create power inefficiencies. It has been found that by altering the position of the speaker diaphragm by only 5% from its nominal position will lead to distortion and a reduction in sound quality (SQ).

Also, even if a sealed speaker system had no parasitic leaks of any kind, then a pressure can build-up in the internal region 101 simply by a change in ambient temperature or altitude of the speaker system.

Therefore, there is need for a small enclosed and liquid tight sealed audio speaker design that provides a high-quality sound output and is easily manufactured. The devices, systems, and methods disclosed herein are designed to overcome these deficiencies.

SUMMARY

Embodiments disclosed herein generally relate to an audio speaker design and a method of manufacturing an audio speaker. Some embodiments of the disclosure may provide an audio speaker, comprising a sealed speaker enclosure having walls that at least partially define an internal region, a speaker assembly mounted on one of the walls, and a gas permeable element that is sealably disposed over a port formed in the one of the walls, wherein the gas permeable element comprises a porous permeable element that is hydrophobic. The porous permeable element may also include a PTFE material that has an average pore size of between about 4 μm and about 50 μm.

Embodiments of the disclosure may also provide an audio speaker, comprising a sealed speaker enclosure having walls that at least partially define an internal region, an active speaker assembly mounted on one of the walls, a gas permeable element that is sealably disposed over a port formed in the one of the walls, wherein the gas permeable element comprises a porous permeable element that is hydrophobic, and an electronic assembly disposed in the internal region of the housing, wherein the electronic assembly comprises a processor, a battery configured to deliver power to the processor, and a wireless transceiver configured to communicate with the processor.

Embodiments of the disclosure may also provide a method of forming an audio speaker, comprising sealably mounting an active speaker assembly to either a first wall or a second wall of a speaker enclosure, sealably mounting a porous permeable element over a port formed through either the first wall or the second wall, and sealably coupling the first wall to the second wall to form an internal region that is in fluid communication with an external region through a plurality of pores formed in the porous permeable element.

Embodiments of the disclosure may also provide a method of delivering an acoustic output from an audio speaker assembly, comprising translating a diaphragm of an active speaker within a diaphragm movement range based on a received audio signal, wherein the active speaker is sealably mounted to a sealed speaker enclosure, generating an acoustic pressure within an internal region of the sealed speaker enclosure, wherein the acoustic pressure is generated by the translation of the diaphragm at a plurality of acoustic frequencies, and preventing acoustic pressures generated in the internal region, at frequencies less than a first frequency, from reaching a first pressure, wherein preventing acoustic pressures from reaching the first pressure comprises positioning a porous permeable element within the sealed speaker enclosure such that air can pass between the internal region and an external region through pores formed in the porous permeable element. In some cases, the diaphragm has a mid-operating position within the diaphragm movement range when the acoustic pressure is being generated, and the mid-operating position is substantially the same as a mid-operating position that would be achieved if the diaphragm was similarly translated in a non-sealed enclosure.

Embodiments of the disclosure may also provide a method of delivering an acoustic output from an audio speaker, comprising generating an acoustic pressure within an internal region of a sealed speaker enclosure, wherein the acoustic pressure is generated by an active speaker that is sealably coupled to the sealed speaker enclosure, and sealably mounting a porous permeable element over a port formed through a wall of the sealed speaker enclosure, wherein the porous permeable element is configured to allow the generation of acoustic pressures at acoustic frequencies greater than a first frequency; and inhibit the generation of a time averaged acoustic pressure.

Embodiments of the disclosure may also provide an audio speaker, comprising a sealed speaker enclosure having one or more enclosure walls that at least partially define an internal region, a speaker assembly mounted on one of the enclosure walls, and a gas permeable element that is positioned to cover a port formed through a first wall of the enclosure walls, wherein the gas permeable element is sealably mounted to the first wall and comprises a porous permeable element that is hydrophobic.

Embodiments of the disclosure may also provide a method of delivering an acoustic output from an audio speaker assembly, comprising translating a diaphragm of an active speaker within a diaphragm movement range based on a received audio signal, wherein the active speaker is sealably mounted to a sealed speaker enclosure. Then generating an acoustic pressure within an internal region of the sealed speaker enclosure, wherein the acoustic pressure is generated by the translation of the diaphragm at a plurality of acoustic frequencies, and then relieving acoustic pressures generated in the internal region by allowing air to pass through a port, which is formed between the internal region and an external region, and pores formed in a gas permeable element that is sealably mounted to a portion of the sealed speaker enclosure. The relieved acoustic pressures can be created at frequencies that are less than a first frequency, such as frequencies less than 20 hertz (Hz).

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, and may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The present disclosure generally provides an apparatus and method of forming a pressure equalizing sealed audio speaker that can be easily manufactured and provides a high quality audio output. In an effort to overcome the shortcomings of conventional sealed speaker designs that typically have small gas leaks, one or more of the embodiments of the disclosure provided herein include a sealed enclosure that has at least one liquid impermeable and gas permeable region that allow the flow of a gas between an interior region and an exterior region, while preventing or substantially inhibiting the movement of a liquid from the exterior region into the internal region. In general, the liquid impermeable and gas permeable regions, or hereafter simply "gas permeable regions," are configured to preferentially allow any slowly changing gas pressures registered between the internal region and exterior region to be relieved, while allowing rapidly changing gas pressures generated by the diaphragm at audible frequencies to function at a desired level to produce a desired sound quality, in accordance with the acoustic engineering of the speaker.

Figure 1:
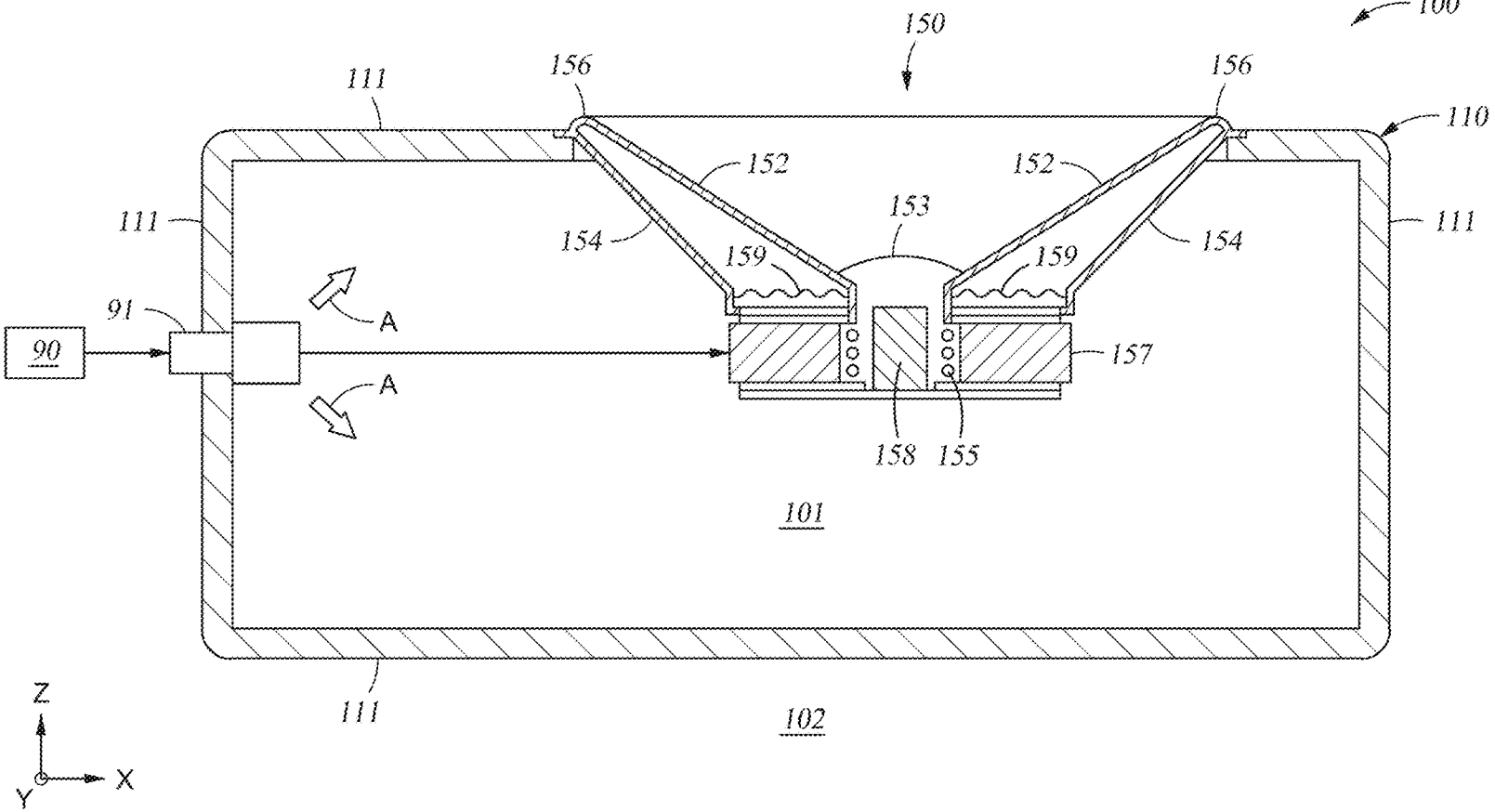
Fig. 1 (PRIOR ART)
FIG. 1 is a side view of a conventional sealed audio speaker assembly.
Figure 2:
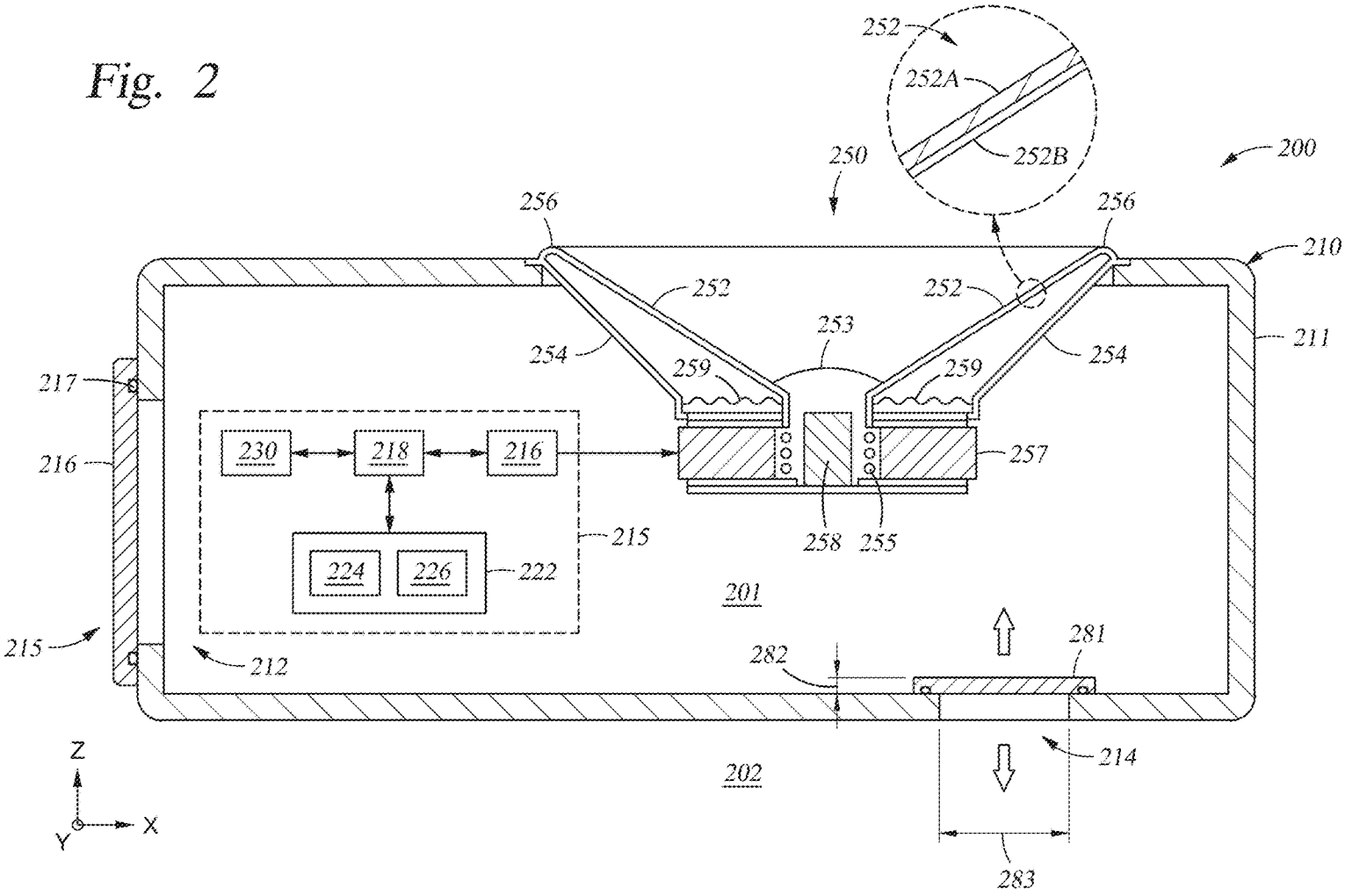
FIG. 2 is a side view of a liquid-tight audio speaker assembly, according to an embodiment of the disclosure provided herein.

FIG. 2 is a side cross-sectional view that illustrates a sealed active speaker assembly 200, according to an embodiment of the disclosure provided herein. The sealed active speaker assembly 200 includes a sealed enclosure 210 that includes a speaker 250, a gas permeable element 280 and a amplifier assembly 215 that is positioned within the internal region 201 of the sealed enclosure 210. The sealed enclosure 210 includes one or more walls 211 that enclose an internal region 201, and is generally configured to prevent or significantly inhibit the movement of a liquid, such as water, from the external region 102 to the internal region 201. In some configurations, one of the one or more walls 211 include a port 212 that is sealed from the external region 102 by use of a cover assembly 215, and is sized to allow access to the speaker assembly 250 and/or one or more of the amplifier assembly 215 components. The cover assembly 215 may include a cover 216 and an elastomeric seal 217 that is sealed against a portion of the wall 211. In one example, the internal volume of the internal region 201 of the speaker assembly 200 is less than about 100 cubic centimeters ($cm^3$) and the active speaker 250 is a 2 inch (in) driver.

The speaker 250 generally includes a sealed diaphragm 252, a frame 254, a sealed surround 256, a voice coil 255, a pole piece 258, a permanent magnet 257, a dust cover 253 and a spider 259. During operation, the amplifier assembly 215 delivers a signal to the speaker 250, which causes the voice coil 255 to move the diaphragm 252 relative to the enclosure 210 (e.g., +/−Z-direction) due to the varying magnetic field generated by the coil 255 reacting against the magnetic field provided by the permanent magnet 257. In some embodiments, the sealed diaphragm 252 includes a diaphragm layer 252A and a coating layer 252B that are configured to sealably enclose a portion of the interior region 201. The diaphragm layer 252A may include a paper, polymer, metal or other material that is light weight and has a desired stiffness for the sized speaker. The coating layer 252B includes a material (e.g., polymer) that is used to coat a surface of the seal diaphragm 252 to assure that air or a liquid will not pass through the sealed diaphragm. In some embodiments, the speaker 250 is sealably mounted to a wall 211 by use of an adhesive, gasket, mechanical clamping method (not shown) and/or other useful method of sealably mounting. In one example, the frame 254 of the speaker 250 is sealably mounted to the wall 211 by use of a gasket.

The amplifier assembly 215 may comprise a processor 218 coupled to input/output (I/O) devices 216, a power source 230 (e.g., battery) and a memory unit 222. Memory unit 222 may include one or more software applications 224 and stored media data 226. Processor 218 may be a hardware unit or combination of hardware units capable of executing software applications and processing data, which may, for example, include delivery of audio information from the speaker 250. In some configurations, the processor 218 includes a central processing unit (CPU), a digital signal processor (DSP), an application-specific integrated circuit (ASIC), and/or a combination of such units. Processor 218 is generally configured to execute the one or more software applications 224 and process the stored media data 226, which are each included within memory unit 222. Memory unit 222 may be any technically feasible type of hardware unit configured to store data. For example, memory unit 222 could be a hard disk, a random access memory (RAM) module, a flash memory unit, or a combination of different hardware units configured to store data. Software application 224, which is stored within the memory unit 222, includes program code that may be executed by processor 218 in order to perform various functionalities associated with the sealed active speaker assembly 200. The I/O devices 216 are coupled to memory unit 222 and may include devices capable of receiving input and/or devices capable of providing output. For example, I/O devices 216 is coupled to the speakers 250 that are configured to generate an acoustic output. I/O devices 216 may also include one or more transceivers configured to establish one or more different types of wired or wireless communication links with other transceivers residing within other computing devices in the external region 102, such as a transceiver within a smart phone, portable computer, tablet or other useful electronic device.

In some embodiments, the gas permeable element 280 includes a porous permeable element 281 that is positioned over an opening 214 formed in a wall 211, and is sealably mounted on a surface of the wall 211. In some embodiments, the porous permeable element 281 is sealably mounted to a wall 211 by use of an adhesive, thermal fusion, mechanical clamping (not shown) or other useful mounting method.

The porous permeable element 281 generally includes a porous and hydrophobic material that has a desired thickness 282 and structural properties to withstand the internal pressures generated by the speaker 250 and any external pressures applied to the sealed enclosure 210 during use (e.g., atmospheric pressure and any specified liquid immersion pressures). The porous permeable element 281 may be formed from a hydrophobic porous plastic material, such as a material selected from a group polytetrafluoroethylene (PTFE), ultra-high molecular weight polyethylene (UHMWPE), high-density polyethylene (HDPE), polypropylene (PP), polyvinylidene fluoride (PVDF), ethylene vinyl acetate (EVA), polyethersulfone (PES) and polyurethane (PU). In one example, the porous permeable element 281 is formed from a porous polytetrafluoroethylene (PTFE) material that has a thickness 282 that is between about 0.1 and 3 mm thick, such as about 0.15 mm thick. The porous permeable element 281 may also be formed from traditionally non-hydrophobic porous material, such as cotton, wool, stainless steel, nylons, polycarbonate, ABS or others materials that are treated with a hydrophobic material or treated with a material that will make its surface hydrophobic. These treatments may be as simple as applying paints or dipping the parts, and as complex as exposing the material to a low pressure plasma. Generally, a material is considered to be hydrophobic if the contact angle of a water droplet on a surface is greater than 90°, and a surface is considered to be hydrophilic if the water droplet contact angle is smaller than 90°.

As noted above, the gas permeable element 280 is configured to preferentially allow any slow changing gas pressures to be relieved (e.g., low frequency pressures, near static pressures or time averaged pressure), while allowing gas pressures generated for short periods of time by the diaphragm movement to be substantially maintained. One will note that the slow changing gas pressures can also be generated by the creation of heat generated by one or more of the components in the active speaker assembly 200 during use. In general, the moderate to high frequency range includes the speaker's desired acoustic range, which may include frequencies greater than 20 hertz (Hz), such as frequencies between 20 Hz and 100 kHz. In an effort to simplify the discussion herein, the slowly changing gas pressures are often referred to herein as the "DC pressure" and the pressures generated by the speaker diaphragm 252 at frequencies in the acoustic range are referred to herein as the "AC pressures". The generation of "AC pressures" is also referred to herein as the generation of an acoustic pressure. One will note that relief of the DC pressure level in the internal region 201, relative to the external region 102, will allow the speaker diaphragm 252 to maintain a desired operating position in the diaphragm movement range (e.g., mid-point of movement range) and a desired operating position in the coil driven region (e.g., mid-point of coil driven region), which will allow the complete and free movement of the diaphragm, prevent distortion in the speaker's reproduction of the delivered audio signal and minimize power inefficiencies. In other words, the relief of the DC pressure level in the internal region 201 can allow the speaker diaphragm 252 to substantially maintain the same operating position (e.g., mid-operating point) when the speaker is generating AC pressures in the sealed enclosure 210 as an operating position (e.g., mid-operating point) that would be achieved if the speaker was disposed in a non-sealed enclosure. In some cases, the relief of the DC pressure level in the internal region 201 can allow the speaker diaphragm 252 to substantially maintain an "operating position" when the speaker is generating AC pressures (e.g., speaker is "on") that is the same as a "resting position" when the speaker is not in use (e.g., speaker is "off").

It has been found that positive or negative DC pressures in the internal region 201 that are less than or equal to as little as 0.1 psi can have an undesirable effect on most active speaker assemblies. One way to determine the DC pressure level in the internal region 201 is to calculate an average internal region pressure over time. In one example, the average pressure can be measured by determining the internal region's average pressure over a period of seconds, tens of seconds or hundreds of seconds. The DC pressure level can also be measured by detecting pressures generated in the internal region that vary at frequencies outside of the speaker's desired acoustic range, which may include frequencies less than 20 Hz, such as frequencies less than 10 Hz, or frequencies less than 1 Hz, or even at a frequency of about zero hertz. A speaker's desired acoustic range may include frequencies greater than zero Hz, such as frequencies greater than 1 Hz, or frequencies greater than 5 Hz, or frequencies greater than 10 Hz, or even at a frequency of greater than 20 Hz.

Figure 3:
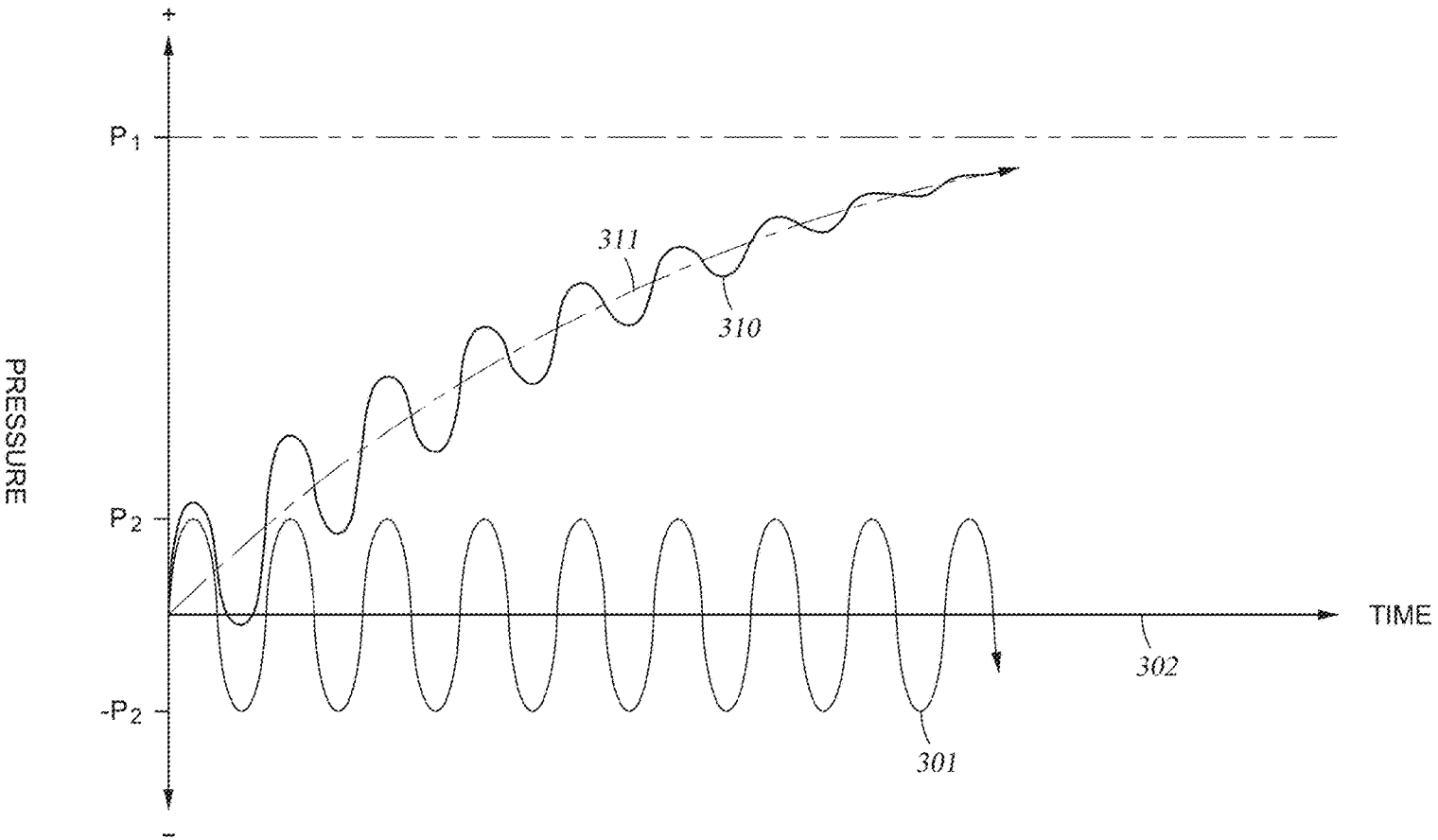
FIG. 3 is a graph illustrating a plot of a pressure generated in an internal region of a conventional sealed speaker assembly over time and a pressure generated in an internal region of the active speaker assembly design over time, according to an embodiment of the disclosure provided herein.

FIG. 3 is a graph that includes a plot of a pressure generated in an internal region of a conventional speaker assembly over time and a pressure generated in an internal region of the active speaker assembly design 200 over time, as illustrated by curve 310 and curve 301, respectively. One will note that the plot of the pressure in the internal region of the conventional speaker assembly, or curve 310, is increasing due to the oscillatory movement of the diaphragm and the presence of a unidirectional leak that is found in a conventional "sealed" speaker enclosure. As illustrated, the pumping action of the speaker diaphragm (e.g., oscillations in curve 310) and the typical single direction leak path will cause the average pressure 311 in the enclosure to climb to a level $P_1$, while the amount of movement of the diaphragm (e.g., pressure fluctuation) is decreasing due to the biasing of the diaphragm from its static position as the DC pressure increases. Alternately, due to the incorporation of the gas permeable element 280 in the active speaker assembly 200, a plot of the pressure in the internal region 201, or curve 301, shows that the DC pressure is maintained at pressure near or at zero pressure (e.g., average pressure 302=0 psig), while the AC pressure varies about the average pressure 302, such as the pressures $+/-P_2$.

To provide a desirable high sound quality with low distortion, it is desirable for the gas permeable element 280 to cause the sealed enclosure 210 to appear as if it is sealed when the pressure rapidly changes, so that the audible frequency AC pressures can be desirably generated within the internal region 201. It is believed that by controlling the physical parameters of the porous permeable element 281, a desired sound quality can be achieved and the amount of generated DC pressure can be reduced to a desired level that will not affect performance of the active speaker assembly 200, while also allowing the active speaker assembly 200 to remain liquid-tight. In some embodiments, by controlling the thickness 282, average pore size, exposed area (e.g., open area of port 283) and pore density of the porous permeable element 281, a liquid-tight active speaker assembly 200 can be created that has a low audio distortion and desirable sound quality during use. It has been found that permeable elements 281 that have an average pore size that is too small will tend to act like the conventional sealed speaker assembly illustrated in FIG. 3, since the generated DC pressure is not able to be adequately relieved from the internal region 201, causing the pressure in the internal region 201 to build up. One will note that pore size, pore density and exposed area all affect the selection of a desired porous permeable element 281. For example, if we hold pore density constant, the same amount of flow and resistance can be delivered through the porous permeable element 281 by varying the exposed area in one direction (e.g., larger) while varying the pore size (e.g., smaller) in the opposite direction. In one example, a 0.5 mm thick PTFE containing porous permeable element 281 having a 4 micrometers (μm) pore size and an exposed area that is about 1.5 mm in diameter acts like the conventional sealed speaker assembly illustrated in FIG. 3. It is believed that a 0.5 mm thick PTFE containing porous permeable element 281 that has an average pore size in at least the 4 to 6 μm range and an exposed area that is about 1.5 mm in diameter is not able to achieve a desired result, and thus produces a pressure versus time curve similar to curve 310 in FIG. 3. However, a 0.5 mm thick PTFE containing porous permeable element 281 that had a similar exposed area as the 4 μm sample, and an average pore size in a range between 8 and 14 μm, was able to achieve a pressure versus time curve similar to curve 301 in FIG. 3. In one embodiment, the porous permeable element 281 is a 0.5 mm thick PTFE containing material that has an average pore size in a range between 10 and 14 μm and an exposed area that is about 1.5 mm in diameter. The porous permeable element may also include a material that has an average pore size of between about 4 μm and about 50 μm and an exposed area sized to achieve the results shown in FIG. 3 for a desired sized driver. In one configuration, the DC type of generated acoustic pressures is less than about 0.1 psig when the porous permeable element 281 is used. In one example, the magnitude of the generated acoustic pressures formed at frequencies less than 20 Hz are less than about 0.5 psig, such as less than 0.1 psig. Alternately, the magnitude of the peak value of the generated acoustic pressures at each generated frequency that is between about 20 Hz and 20,000 Hz are greater than about 0.1 psig, such as greater than 0.2 psig, or greater than 0.5 psig, or greater than 1 psig, or even greater than 5 psig.

Alternately, it is believed that a porous permeable element 281 that has an average pore size that is too large will not allow the desired AC pressures to adequately develop during normal use of the active speaker assembly 200, which will affect the sound quality. Selecting a porous permeable element 281 that has an average pore size that is too large will also make the enclosure more susceptible to liquid intrusion through the porous permeable element 281 of the gas permeable element 280. One will note that most liquid-tight speaker assembly specifications require that the speaker assembly have no liquid permeation after being submerged in the water to a level that achieves an external pressure of 1.5 psig for about 30 minutes.

Figure 4A:
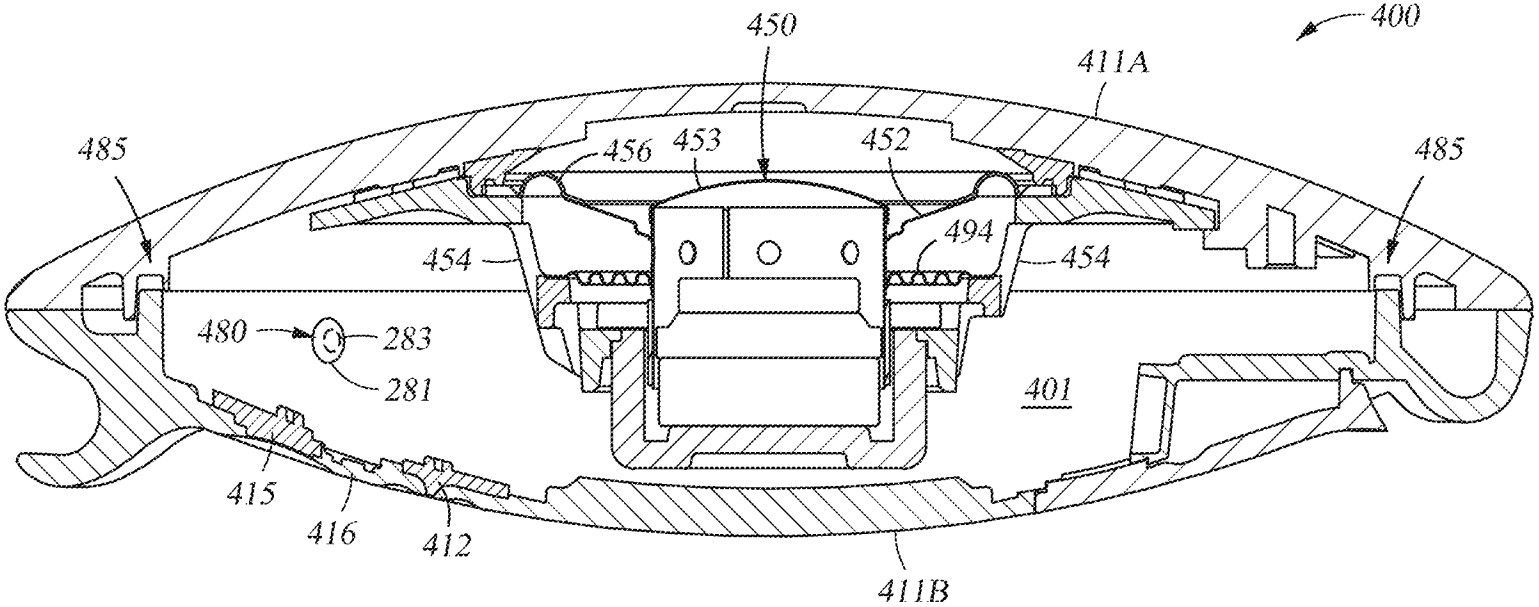
FIG. 4A is a side view of a liquid-tight audio speaker assembly, according to an embodiment of the disclosure provided herein.
Figure 4B:
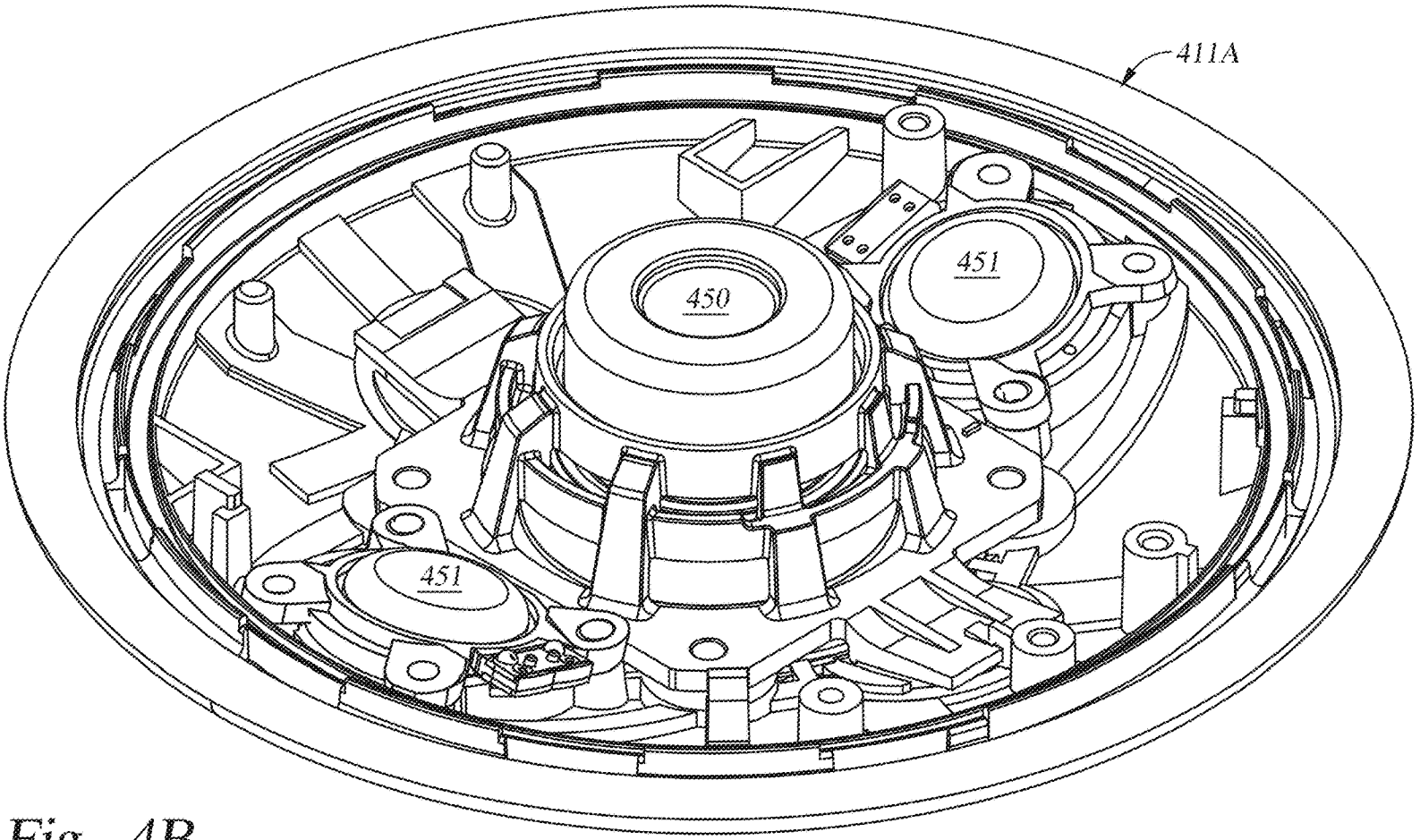
FIGS. 4B-4C are isometric views of components in the liquid-tight audio speaker assembly illustrated in FIG. 4A, according to an embodiment of the disclosure provided herein.
Figure 4C:
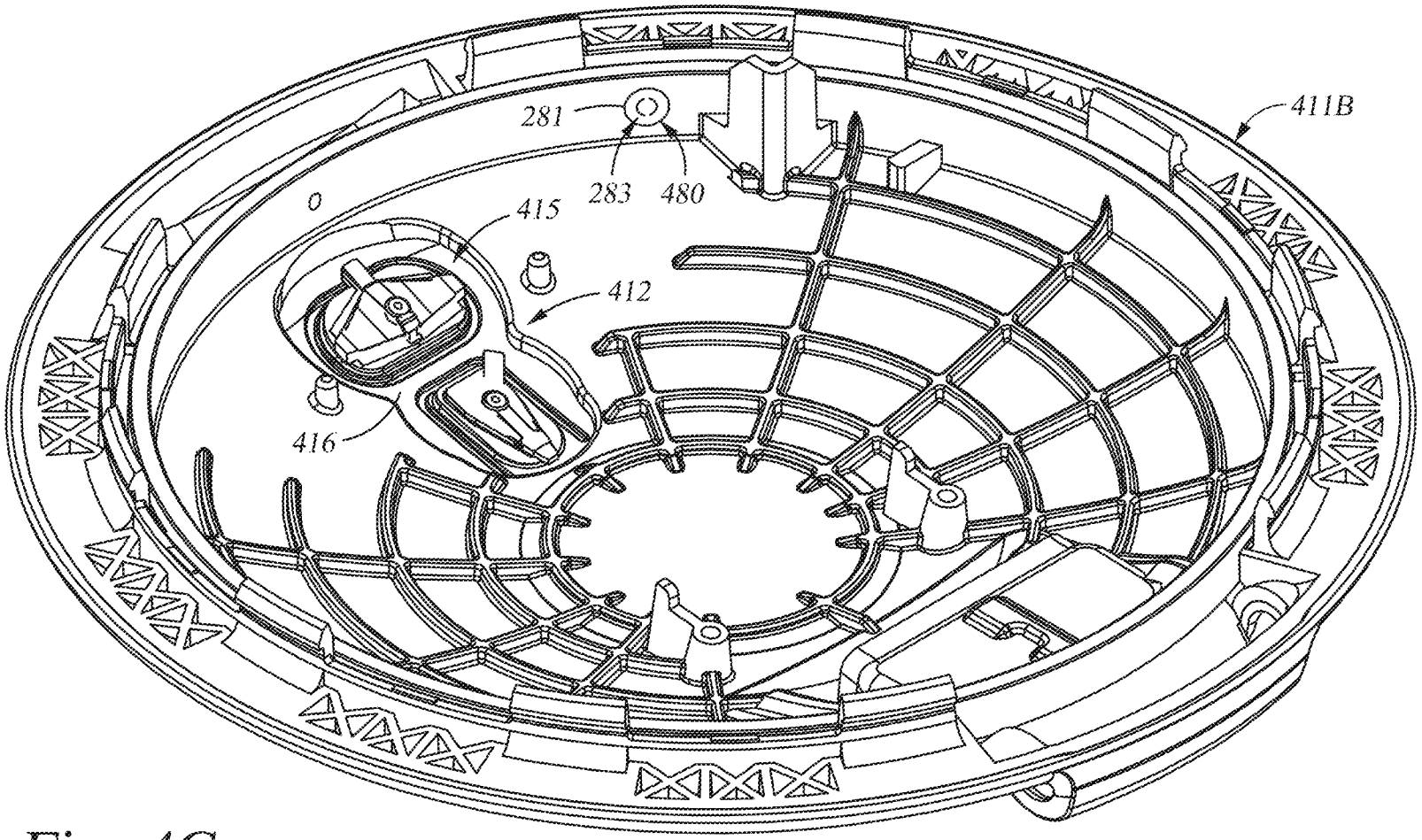

FIG. 4A is a side cross-sectional view that illustrates a sealed active speaker assembly 400, according to an embodiment of the disclosure provided herein. FIGS. 4B-4C are isometric views of components in the liquid-tight audio speaker assembly illustrated in FIG. 4A. The sealed active speaker assembly 400 includes a sealed enclosure 410 that includes a first active speaker 450, two second active speakers 451, a gas permeable element 480 and a driver assembly (not shown) that is positioned within the internal region 401 of the sealed enclosure 410. The sealed enclosure 410 includes an upper wall 411A and a lower wall 411B that enclose an internal region 401. The upper wall 411A and a lower wall 411B may be sealed together using an elastomeric seal 485. In some configurations, one of the walls 411A and 411B include a port 412 that is sealed from the external region 102 by use of a cover assembly 415. The cover assembly 415 may include a cover 416 and an elastomeric seal (not shown) that is sealed against a portion of the wall 411B. The gas permeable element 480 includes the porous permeable element 281 that is positioned over a 1.5 mm diameter port 283 formed in the wall 411B, and is sealably mounted on a surface of the wall 411B. In some configurations, the port 283 may have a diameter of between about 0.5 mm and 10 mm, such as a diameter between 0.5 mm and 4 mm, and have a length of between about 0.5 mm and 12 mm, such as a length of between 1 mm and 4 mm. The port 283 may have an aspect ratio (e.g., diameter/length ratio) of between about 0.1 and about 4. The sealed enclosure 410 is thus generally configured to prevent or significantly inhibit the movement of a liquid from the external region 102 to the internal region 401. In one example, the internal volume of the internal region 401 of the speaker assembly 400 is about 95 cubic centimeters ($cm^3$). The speaker 450 generally includes a sealed diaphragm 452, a frame 454, a sealed surround 456, a voice coil (not shown), a pole piece (not shown), a permanent magnet (not shown), a dust cover 453 and a spider 459.

Furthermore, the features of the embodiments disclosed herein are not limited to being applied to audio speakers and may be applied to any electronic device that is configured to be liquid impermeable, but allow some transfer of a gas between two regions of a device. The features of the embodiments disclosed herein can also provide benefits for any electronic device that uses a sealed interior volume that is gas permeable. In some device configurations, the ports, or opening, formed between the two regions have a length and an inner diameter that is specifically designed to provide a desired restriction to fluid movement between the two adjacent regions. The physical attributes of the port may also include a gas permeable element 480 that is disposed over the port formed in the wall. The gas permeable element 480 can be configured to further control the fluid movement between the two adjacent regions.

In some embodiments, the active speaker assembly 400 (FIG. 4A) is designed such that it will achieve an IPx7 rating (e.g., water tight rating). An IPx7 rating generally requires that a speaker assembly be submerged in a meter of water for 30 minutes with zero water ingress and still operate properly after recovery.

As noted above, it has been found that if the audio device unit is not completely "sealed", a pressure will build up quickly inside the unit. The pressure build up creates an offset in the diaphragm position, which pushes the neutral point of the driver out (or forward). Once the driver is sufficiently forward it will not operate properly, and will display audible distortion. The distortion created by an incompletely sealed unit can also occasionally occur due to the diaphragm being biased in the opposite direction (e.g., driver moved inward). In this case, air is forced from the internal region, which creates a "vacuum" therein that causes the driver to move inward from its neutral position.

Figure 5:
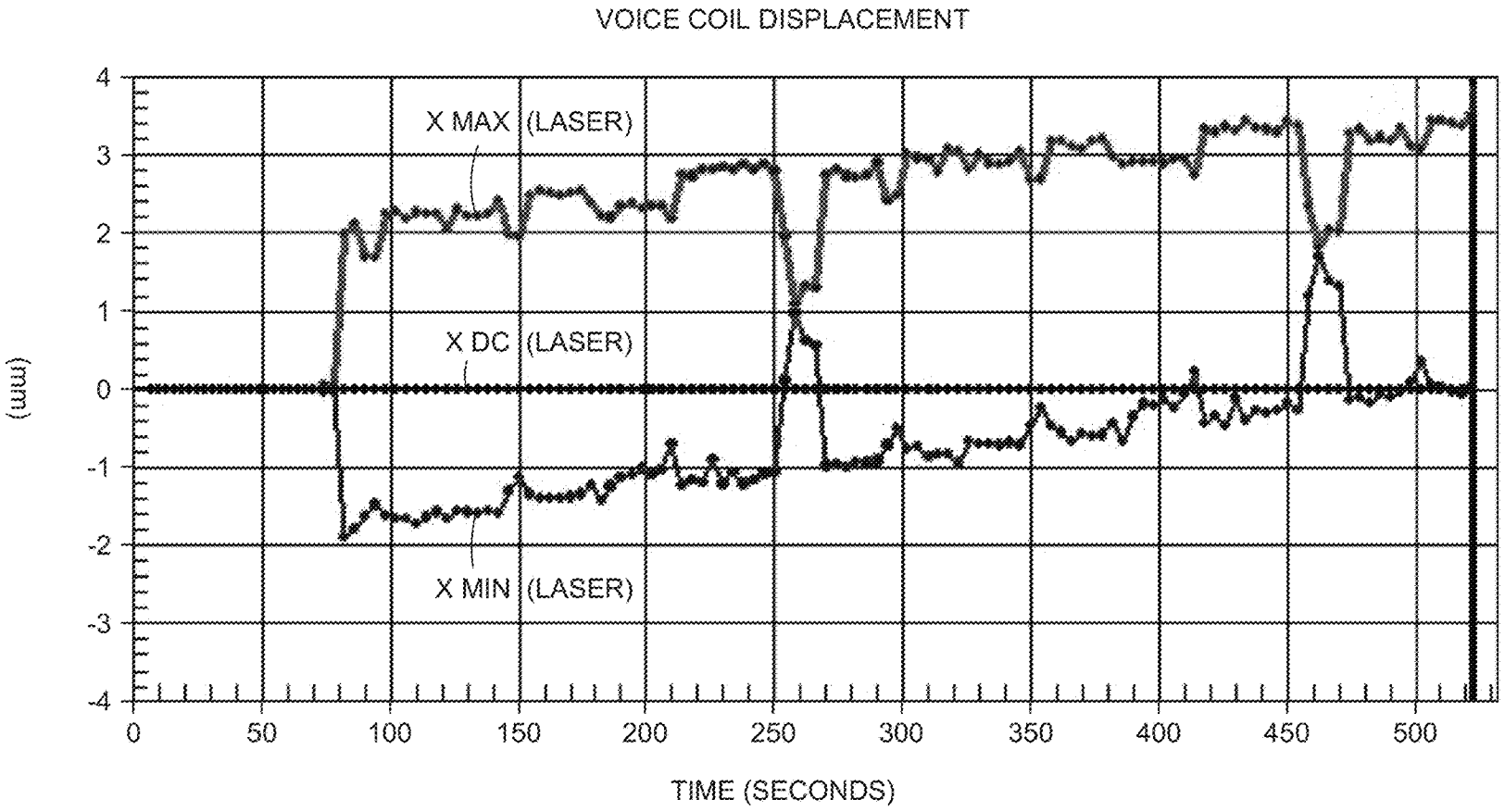
FIG. 5 is a graph of the position of a diaphragm in a conventional sealed speaker versus time.

FIG. 5 is a graph of the position of a diaphragm in a conventional sealed speaker versus time, as the diaphragm is generating an audio output. As illustrated in FIG. 5, a first generated audio output is delivered from a first start time at 80 seconds to a first end time at 260 seconds, and a second generated audio output is delivered from a second start time at 260 seconds to second end time at 470 seconds. As shown in FIG. 5, the generation of the first and the second generated audio outputs creates about a 1.9 mm offset in the diaphragm position after only 380 seconds of use. In this example, the conventional diaphragm containing unit that was tested was sealed enough at ambient temperature and barometric pressure to pass a water and air ingress test, but not sealed enough to survive the pressures created by the diaphragm movement generated during normal audio generation type operations.

Figure 6:
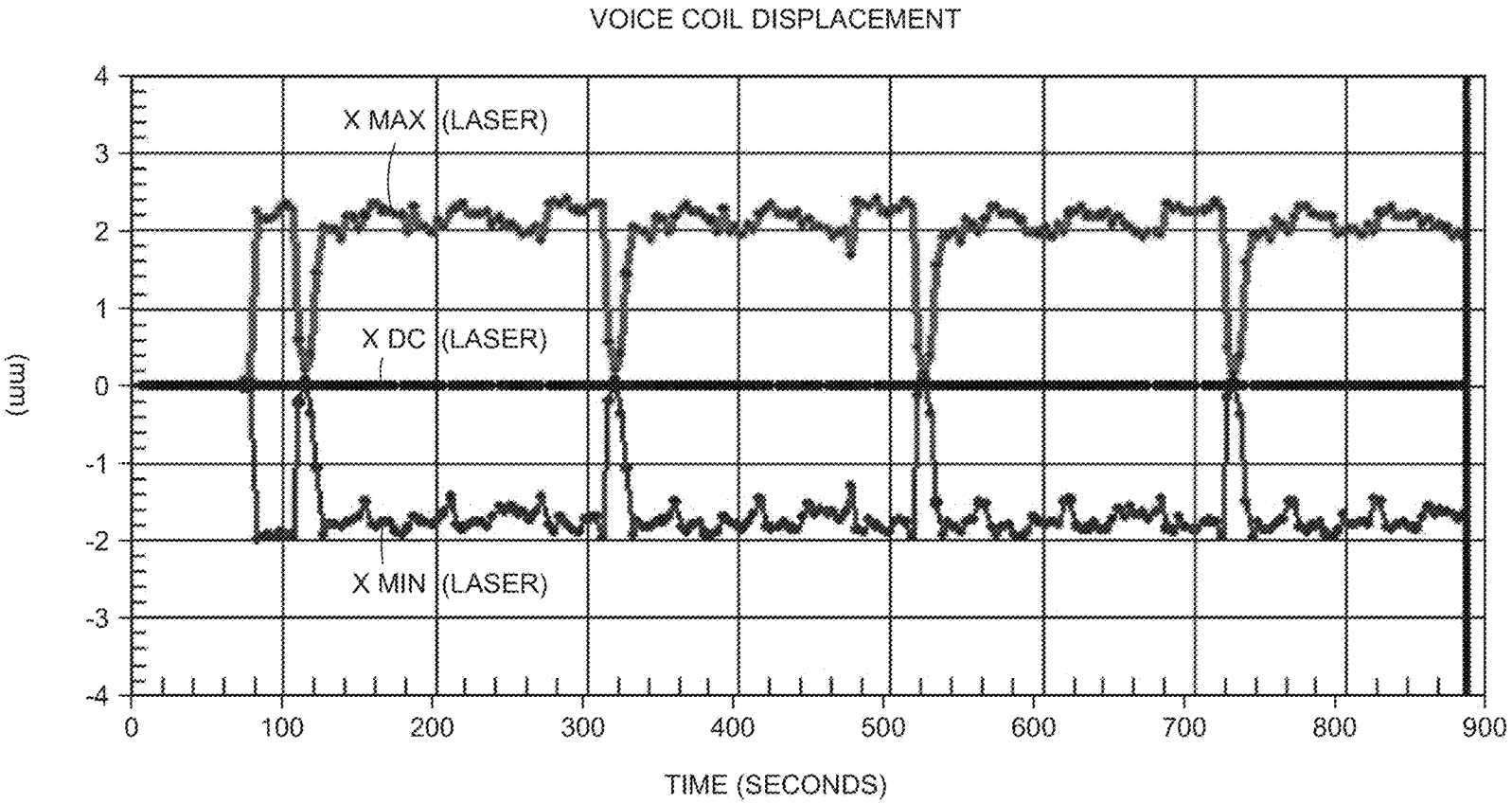
FIG. 6 is a graph of the position of a diaphragm in a sealed speaker versus time, according to an embodiment of the disclosure provided herein.

In an effort to resolve the issues seen in conventional audio devices illustrated in FIG. 5, the sealed active speaker assembly 200, 400 designs discussed above can be utilized to solve these problems. Embodiments of the present disclosure include the use of the gas permeable element 280 to reliably release the DC generated pressure generated during normal operation. The gas permeable element 280 is generally configured so that the flow rate of air passing through the opening (port) and gas permeable element 280 does not create other audio delivery issues, such as whistling, chuffing or squeaking, and does not allow water to enter the sealed active speaker assembly. The properly sized opening (e.g., length and diameter), over which the gas permeable element 280 is disposed, allows the unit to remain at a DC pressure equilibrium during use, as shown in FIG. 6. As illustrated in FIG. 6, the generation of the various generated audio outputs (e.g., three complete cycles are shown) did not create an offset in the diaphragm position even after about 610 seconds of use.

Figure 7:
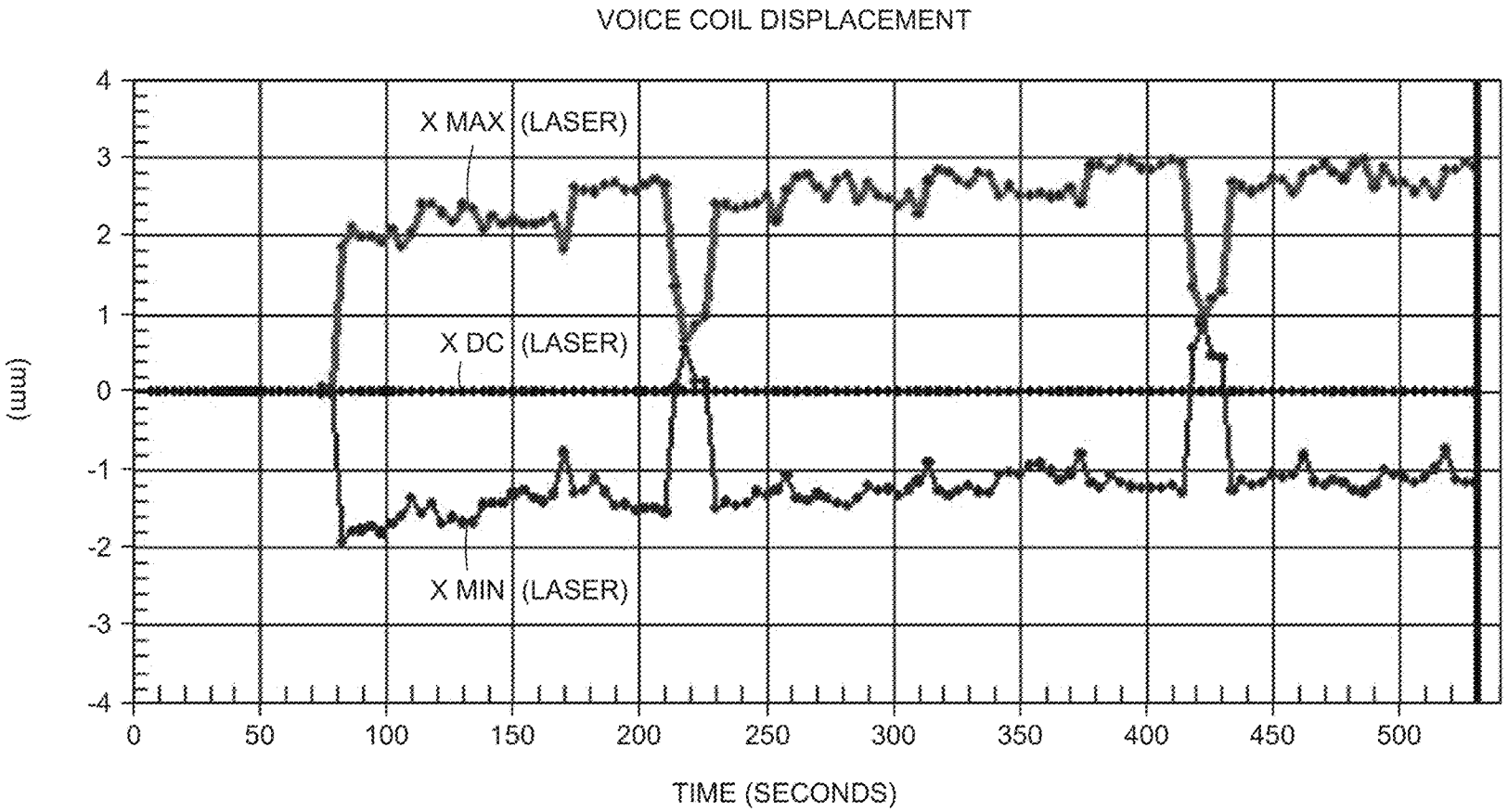
FIG. 7 is a graph of the position of a diaphragm in a sealed speaker versus time, according to an embodiment of the disclosure provided herein.

However, if the gas permeable element 280 is too restrictive the DC pressure equilibrium issue illustrated in FIG. 5 can be created. An example of a restrictive gas permeable element 280 is shown in FIG. 7. In one example, the porous permeable element 281 in this case had a 4 μm average pore size in a 1.5 mm thick porous piece that is disposed over a 1.5 mm diameter port. As illustrated in FIG. 7, the position of a diaphragm in a sealed speaker that has a restrictive gas permeable element 280 disposed over an opening in the housing, can have a 1 mm offset in the diaphragm's neutral position after only 350 seconds of use.

Figure 8:
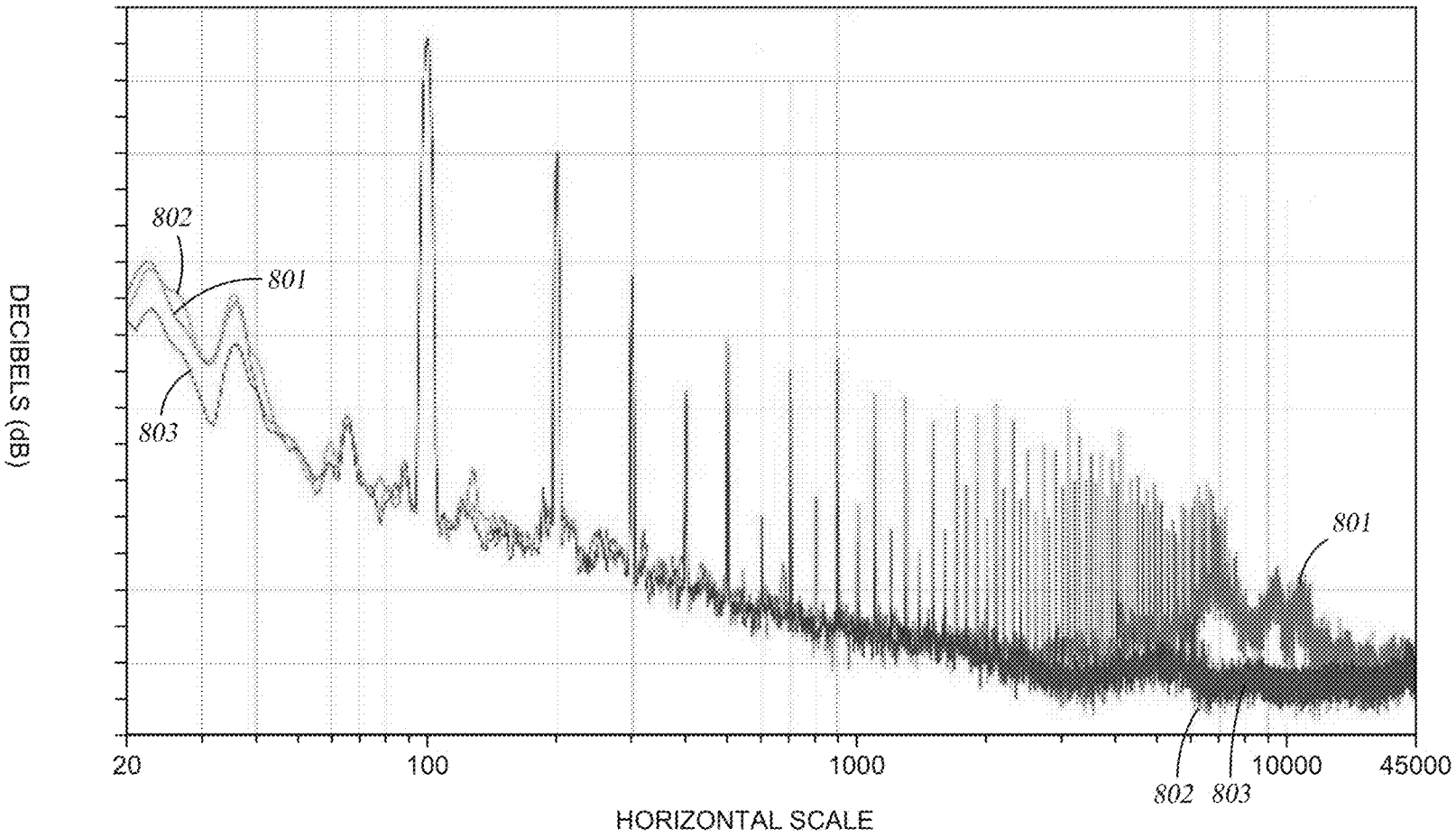
FIG. 8 illustrates an audio output of differently configured speaker assemblies across a frequency range, according to an embodiment of the disclosure provided herein.

FIG. 8 illustrates an audio output of differently configured speaker assemblies across a frequency range between about 1 and 20,000 hertz (Hz). As illustrated in FIG. 8, one can see the effect of sealing a speaker assembly on the audio spectrum generated during use. Curve 801 illustrates the audio frequency output of a sealed speaker assembly that has an unrestricted 1 mm opening in a sealed housing. Curve 802 illustrates the audio frequency output of an ideal fully sealed speaker assembly. Curve 803 illustrates the audio frequency output of a sealed speaker assembly that has a 10 μm average pore size and 1.5 mm thick porous piece that is disposed over a 1.5 mm diameter port in the sealed housing. As illustrated in FIG. 8, curve 801 contains a significant amount of distortion at frequencies greater than 4,000 Hz versus curves 802 and 803, which were nearly identical. Therefore, sealed speaker assemblies used to generate curves 802 and 803 produced superior acoustic properties versus a sealed speaker assembly that had too large of an opening in the sealed housing, as illustrated in curve 801.

Figure 10:
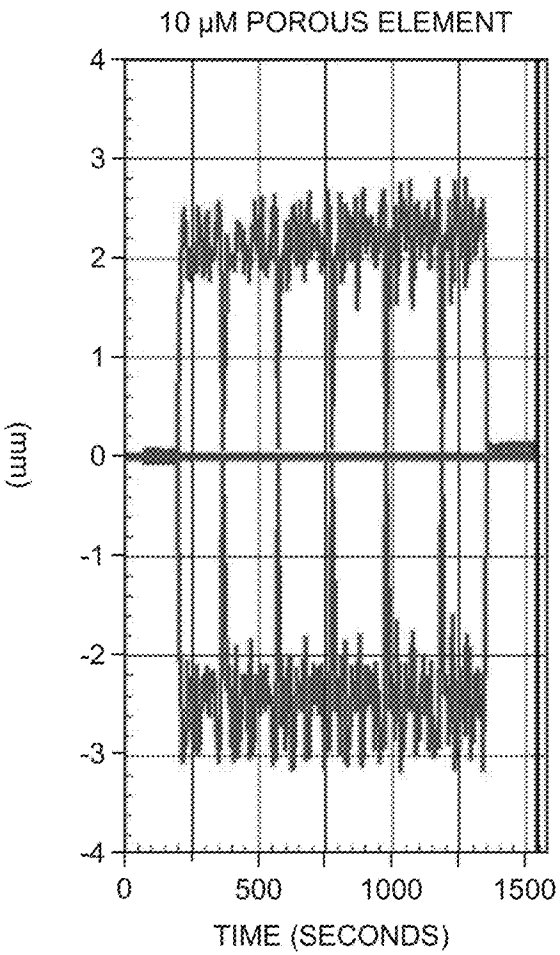
FIG. 10 is a graph of the position of a diaphragm in a sealed speaker versus time, according to an embodiment of the disclosure provided herein.
Figure 9:
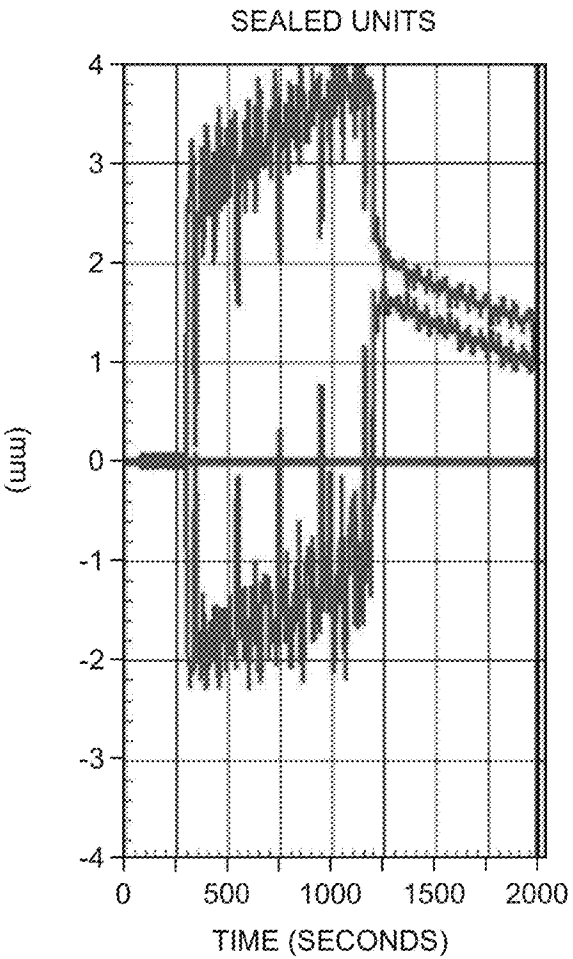
FIG. 9 is a graph of the position of a diaphragm in a sealed speaker versus time.

FIG. 9 is a graph that illustrates the position of a diaphragm that is disposed in a speaker assembly that has a porous permeable element 281 that is too restrictive. FIG. 10 is a graph that illustrates the effect of having a desirably configured porous permeable element 281 in a sealed speaker assembly. The porous permeable element 281 in this example had a 10 μm average pore size in a 1.5 mm thick porous piece that is disposed over a 1.5 mm diameter port in the sealed housing.

While the foregoing is directed to embodiments of the present disclosure, other and further embodiments of the disclosure may be devised without departing from the basic scope thereof, and the scope thereof is determined by the claims that follow.

What is claimed is:

1. An audio speaker, comprising:

a sealed speaker enclosure having one or more enclosure walls that at least partially define an internal region;

a speaker assembly mounted on one of the one or more enclosure walls; and a liquid-tight, gas permeable, porous element that is disposed between a port formed through a first wall of the one or more enclosure walls and the internal region, wherein the liquid-tight, gas permeable, porous element is sealably mounted to the first wall, the liquid-tight, gas permeable, porous element is hydrophobic, and the liquid-tight, gas permeable, porous element is configured to allow a generation of acoustic pressures in the internal region by the speaker assembly at acoustic frequencies greater than a first frequency and relieve acoustic pressures generated in the internal region by allowing air to pass through the port, when the relieved acoustic pressures are created at frequencies less than the first frequency.

2. The audio speaker of claim 1, wherein the liquid tight, gas permeable, porous element is a PTFE material that has an average pore size of between about 4 μm and about 50 μm.

3. The audio speaker of claim 1, wherein the speaker assembly comprises an active speaker assembly and a passive element assembly.

4. The audio speaker of claim 3, further comprising:

an electronic assembly disposed in the internal region of the sealed speaker enclosure, wherein the electronic assembly comprises:

a processor;

a battery configured to deliver power to the processor; and a wireless transceiver configured to communicate with the processor.

5. The audio speaker of claim 4, wherein the liquid-tight, gas permeable, porous element comprises a material that has an average pore size of between about 10 μm and about 14 μm.

6. The audio speaker of claim 5, wherein the port has a diameter and a length, and the diameter is between about 0.5 mm and 10 mm and the length is between about 0.5 mm and 12 mm.

7. A method of forming an audio speaker, comprising:

sealably mounting an active speaker assembly to either a first wall or a second wall of a speaker enclosure;

sealably mounting a liquid-tight, gas permeable, porous element over a port formed through either the first wall or the second wall;

sealably coupling the first wall to the second wall to form an internal region that is in fluid communication with an unenclosed external region through a plurality of pores formed in the liquid-tight, gas permeable, porous element, wherein the liquid-tight, gas permeable, porous element is configured to:

allow a generation of acoustic pressures in the internal region by the active speaker assembly at acoustic frequencies greater than a first frequency; and inhibit a generation of a time averaged acoustic pressure.

8. The method of claim 7, wherein a surface of the pores formed in the liquid-tight, gas permeable, porous element is hydrophobic.

9. The method of claim 7, wherein the liquid-tight, gas permeable, porous element is a PTFE material that has an average pore size of between about 4 μm and about 50 μm.

10. The method of claim 7, wherein the time averaged acoustic pressure is substantially zero.

11. The method of claim 10, wherein the first frequency is between about 1 Hz and about 20 Hz.

12. A method of delivering an acoustic output from an audio speaker assembly, comprising:

translating a diaphragm of an active speaker within a diaphragm movement range based on a received audio signal, wherein the active speaker is sealably mounted to a sealed speaker enclosure;

generating an acoustic pressure within an internal region of the sealed speaker enclosure, wherein the acoustic pressure is generated by the translation of the diaphragm at a plurality of acoustic frequencies; and relieving acoustic pressures generated in the internal region by allowing air to pass through a port, which is formed between the internal region and an external region, and pores formed in a liquid-tight, gas permeable, porous element that is sealably mounted to a portion of the sealed speaker enclosure, wherein the relieved acoustic pressures are created at frequencies less than a first frequency.

13. The method of claim 12, wherein the first frequency is greater than zero hertz and less than 20 Hz.

14. The method of claim 12, wherein the acoustic pressures formed at frequencies less than the first frequency are less than about 0.1 psig.

15. The method of claim 14, wherein the liquid-tight, gas permeable, porous element is configured to allow the generation of acoustic pressures of greater than 0.1 psig at acoustic frequencies greater than the first frequency.

16. The method of claim 14, wherein the first frequency is greater than zero hertz and less than 1 Hz.

17. The method of claim 12, wherein the generated acoustic pressures include a time averaged acoustic pressure that is substantially zero while the diaphragm is being translated.

18. The method of claim 12, wherein the diaphragm has a mid-operating position within the diaphragm movement range when the acoustic pressures are being generated, and the mid-operating position is substantially the same as a mid-operating position that would be created when the diaphragm is similarly translated in a non-sealed enclosure.

19. The method of claim 12, wherein the liquid-tight, gas permeable, porous element is adapted to prevent water from passing from the external region to the internal region when immersed in one meter of room temperature water for 30 minutes.

20. An audio speaker, comprising:

a sealed speaker enclosure having one or more enclosure walls that at least partially define an internal region;

a speaker assembly mounted on one of the one or more enclosure walls; and a liquid-tight, gas permeable, porous element that is disposed between a port formed through a first wall of the one or more enclosure walls and the internal region, wherein the liquid-tight, gas permeable, porous element is sealably mounted to the first wall, the liquid-tight, gas permeable, porous element is hydrophobic, and the liquid-tight, gas permeable, porous element is configured to allow a generation of acoustic pressures in the internal region by the speaker assembly at acoustic frequencies greater than a first frequency and inhibit a generation of a time averaged acoustic pressure.

* * * * *